US005392799A

United States Patent [19]

Lai

[11] Patent Number: 5,392,799

[45] Date of Patent: Feb. 28, 1995

[54] FOUR-SECTION UMBRELLA STRUT SPREADER STRUCTURE

[76] Inventor: Chen M. Lai, F38, 3rd Floor, No. 5, Hsin Yi Road, Sec. 5, Taipei, Taiwan, Prov. of China

[21] Appl. No.: 282,000

[22] Filed: Jul. 29, 1994

[51] Int. Cl.[6] ..... A45B 19/00

[52] U.S. Cl. ..... 135/25.3; 135/31; 403/395

[58] Field of Search ..... 135/25.3, 29, 30, 31, 135/32, 25.1; 403/395, 388, 389

[56] References Cited

U.S. PATENT DOCUMENTS

| | | | |
|---|---|---|---|
| 3,535,751 | 10/1970 | Batchelor | 403/395 X |
| 4,815,489 | 3/1989 | Yang | 135/25.3 |
| 4,966,180 | 10/1990 | Lai | 135/29 X |
| 5,048,550 | 9/1991 | Su | 135/25.3 |
| 5,135,016 | 8/1992 | Stiller | 135/25.3 |
| 5,193,565 | 3/1993 | Huang | 135/29 X |
| 5,297,572 | 3/1994 | Kuo | 135/25.3 |

FOREIGN PATENT DOCUMENTS

| | | | |
|---|---|---|---|
| 2300153 | 7/1973 | Germany | 135/25.3 |

*Primary Examiner*—Lanna Mai

*Attorney, Agent, or Firm*—Morton J. Rosenberg; David I. Klein

[57] ABSTRACT

The invention herein relates to a kind of four-section umbrella strut spreader structure that mainly offers a highly safe and smoothly operating umbrella strut spreader structure to increase overall practicality and which consists of a structural improvement within the strut spreader members through the addition of an upward facing U-shaped opening and a T-shaped guide on the third main strut member, wherein a leaf-type strut member is inserted through the U-shape opening to maintain smooth action during the opening and the folding of the umbrella. Furthermore, the third main strut member can be configured as a S-shaped strut spreader element to reduce the overall physical dimensions of the umbrella strut spreader rear ends.

2 Claims, 12 Drawing Sheets

FOUR-SECTION UMBRELLA STRUT SPREADER STRUCTURE

BACKGROUND OF THE INVENTION

As indicated in FIG. 1 and FIG. 2, in a conventional four-section umbrella strut spreader structure, the U-shaped opening in the umbrella strut member (a) near the center pole faces downward. When the user opens or closes the umbrella strut spreaders during operation, the hands are easily injured by the umbrella strut member (a) if caution is not exercised. Furthermore, there is a sleeve (d) that directly conjoins the leaf-type strut member (b) to the third main strut member (c) (as indicated in FIG. 2) and the leaf-type strut member (b) is positioned at a relatively greater distance from the third main strut member (c) at the base (cl) of the sleeve (d), which results in difficult operation when the umbrella is opened and folded as well as frequent malfunctions.

In view of the aforementioned shortcomings, the primary objective of the invention herein is to overcome the disadvantages of conventional four-section umbrella strut spreader structures to offer a safe and smoothly operating four-section umbrella strut spreader structure. The innovations and functions of the invention herein are elaborated in the attached drawings and detailed description.

BRIEF DESCRIPTION OF THE DRAWINGS

FIG. 5A is an enlarged view of a coupling to the second main strut member;

DETAILED DESCRIPTION OF THE INVENTION

Figure 1:
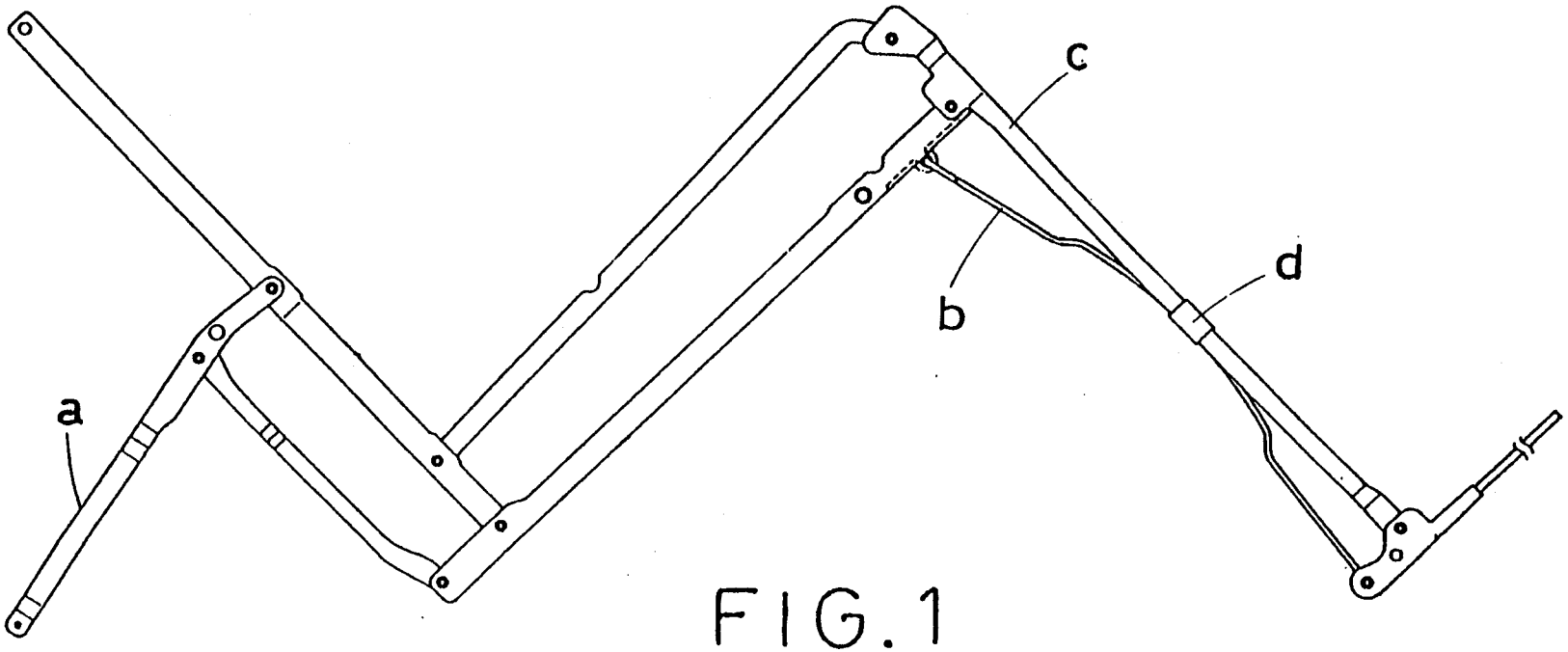
FIG. 1 PRIOR ART
FIG. 1 is an orthographic drawing of a conventional umbrella strut spreader when open.
Figure 2:
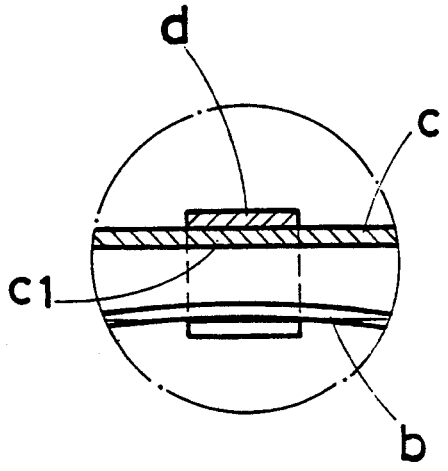
FIG. 2 PRIOR ART
FIG. 2 is a partial cross-sectional drawing of a conventional umbrella strut spreader.
Figures 3, 3A, 3B:
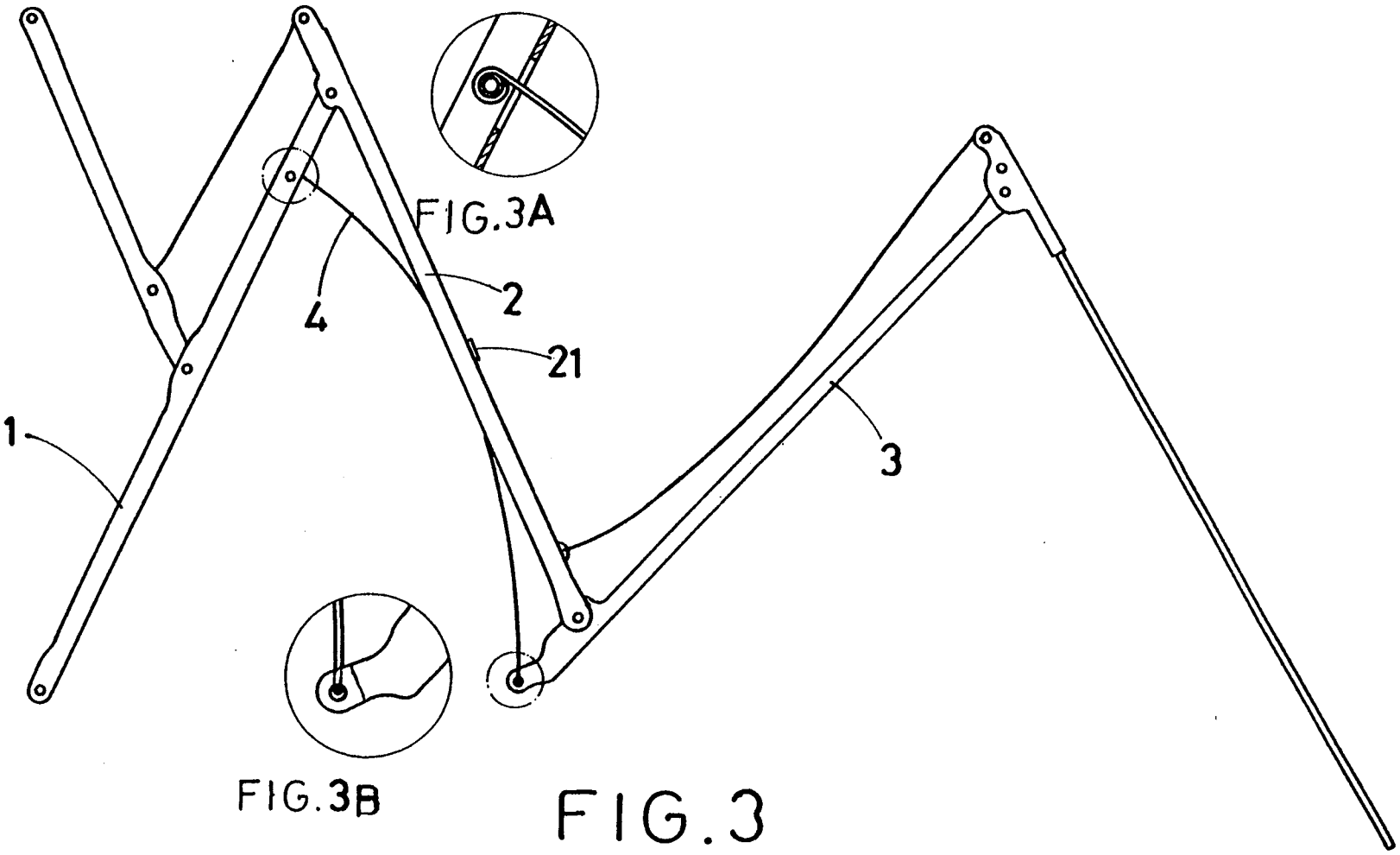
FIG. 3 is an orthographic drawing of the umbrella strut spreader of the invention herein.
FIG. 3A is an enlarged view of the leaf strut member end section secured to the first main strut member.
FIG. 3B is an enlarged view of the lead strut member end section secured to the third main strut member.
Figure 4:
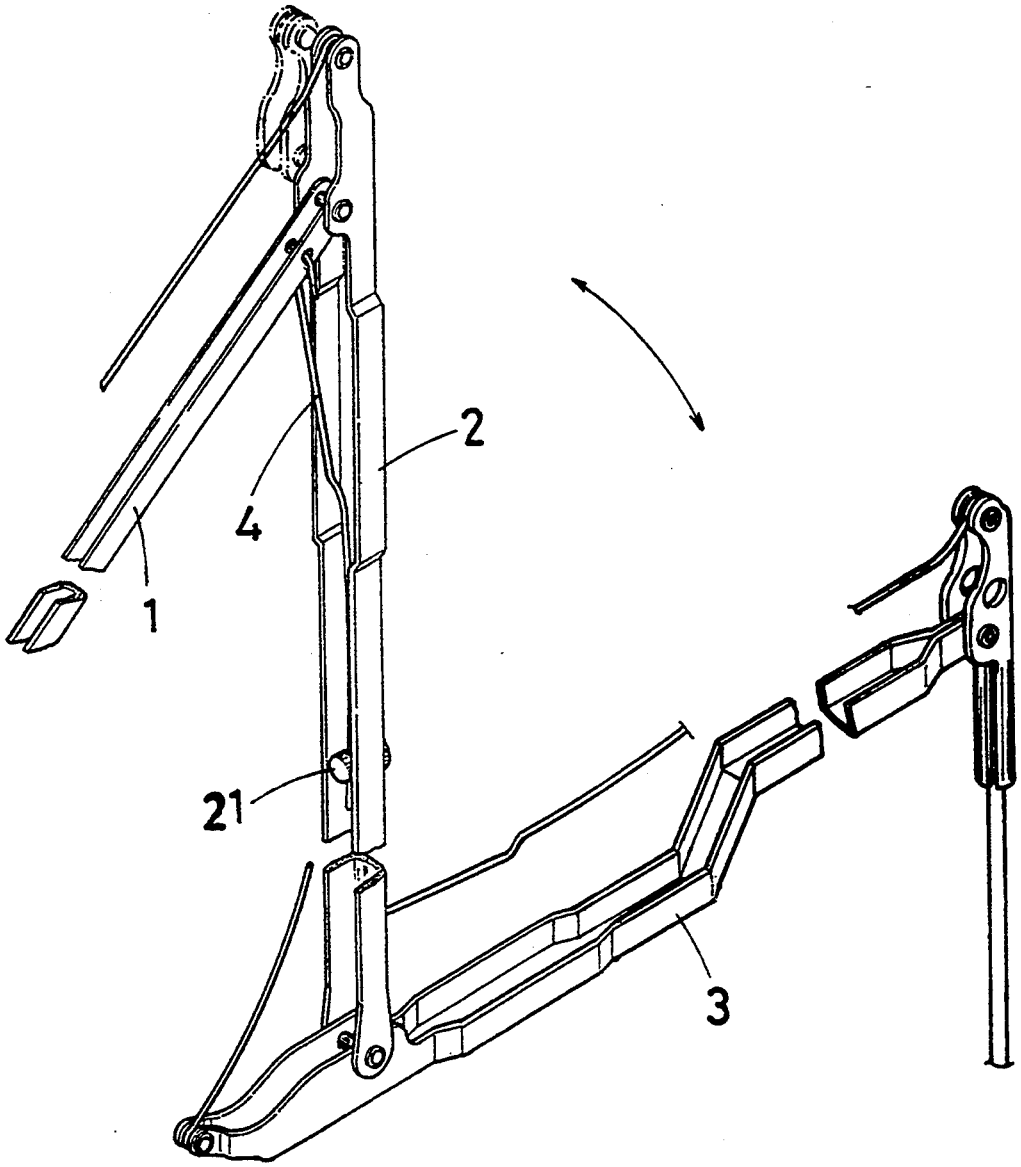
FIG. 4 is a partial isometric exploded drawing of the invention herein.
Figure 5:
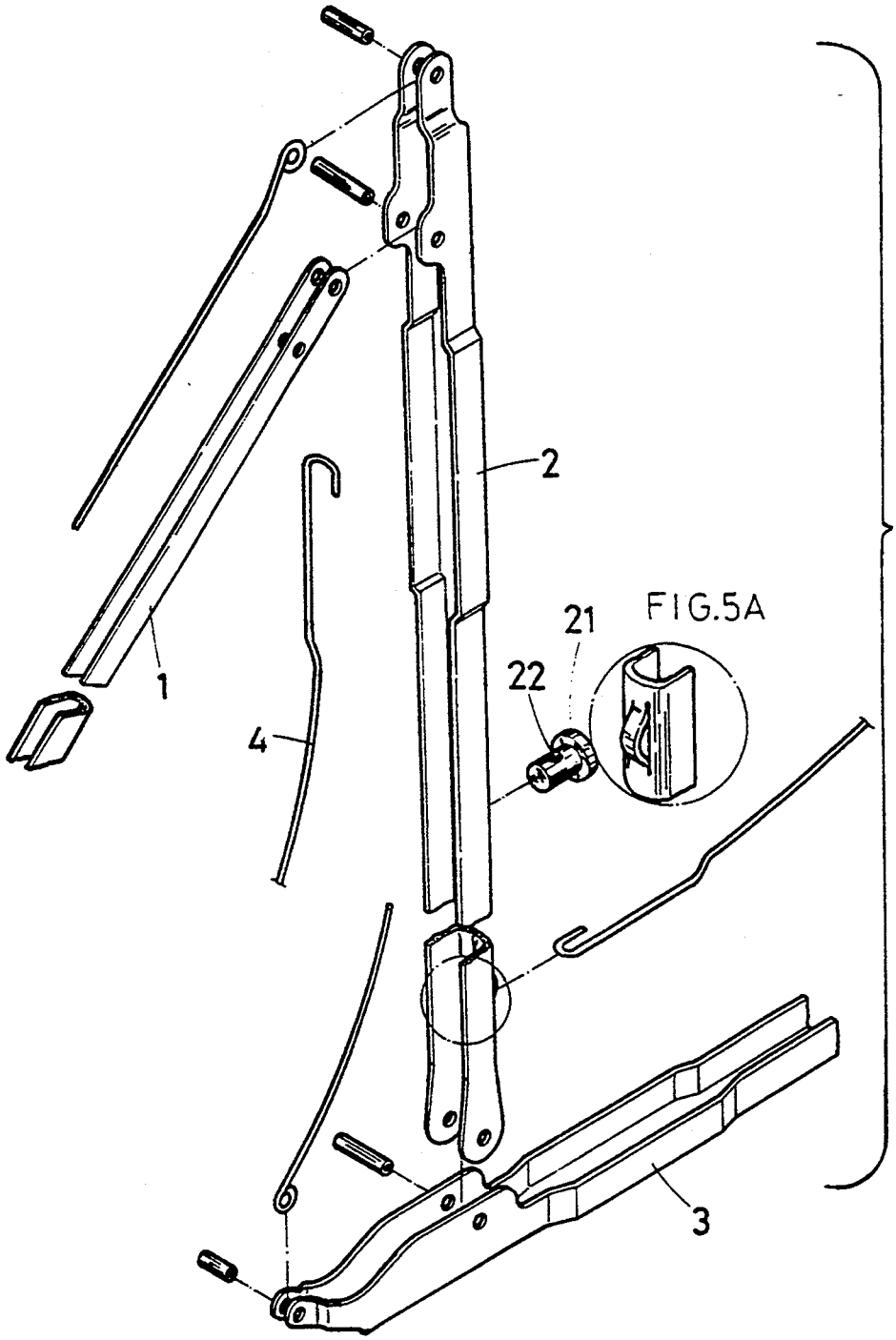
FIG. 5 is a partial isometric exploded drawing of the invention herein.
Figure 6:
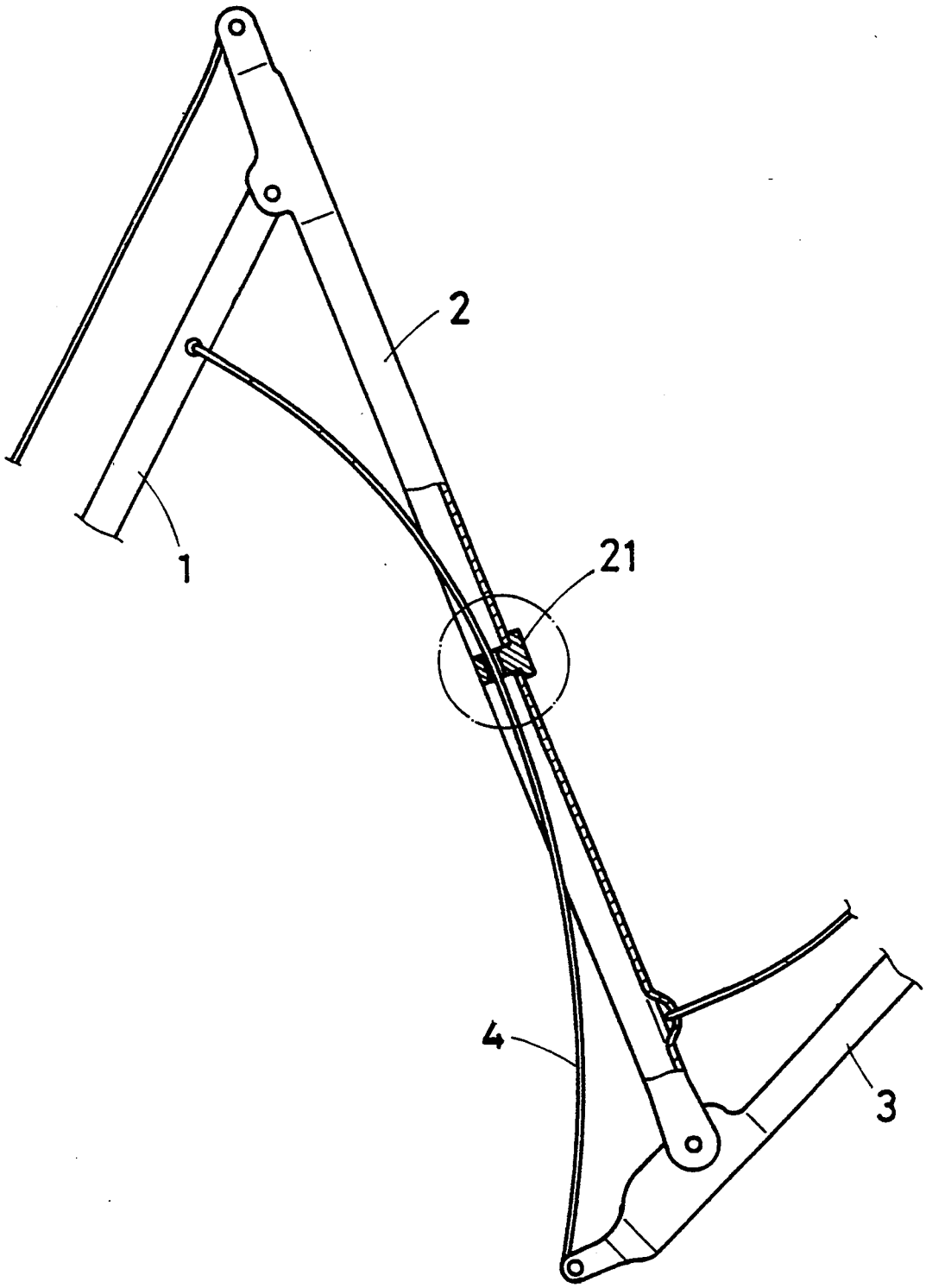
FIG. 6 is a partial orthographic exploded drawing of the invention herein.
Figure 7:
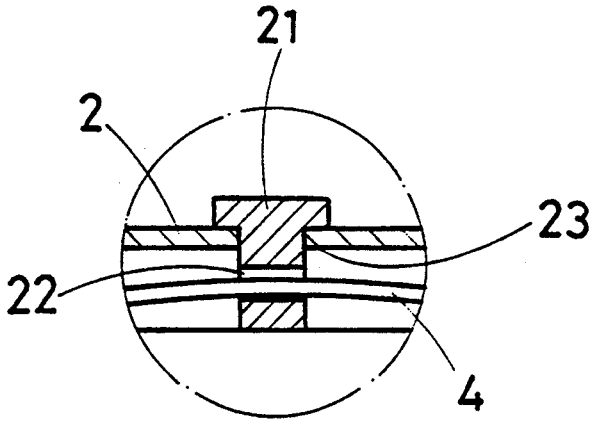
FIG. 7 is an orthographic drawing with a magnified view of FIG. 6.
Figure 8:
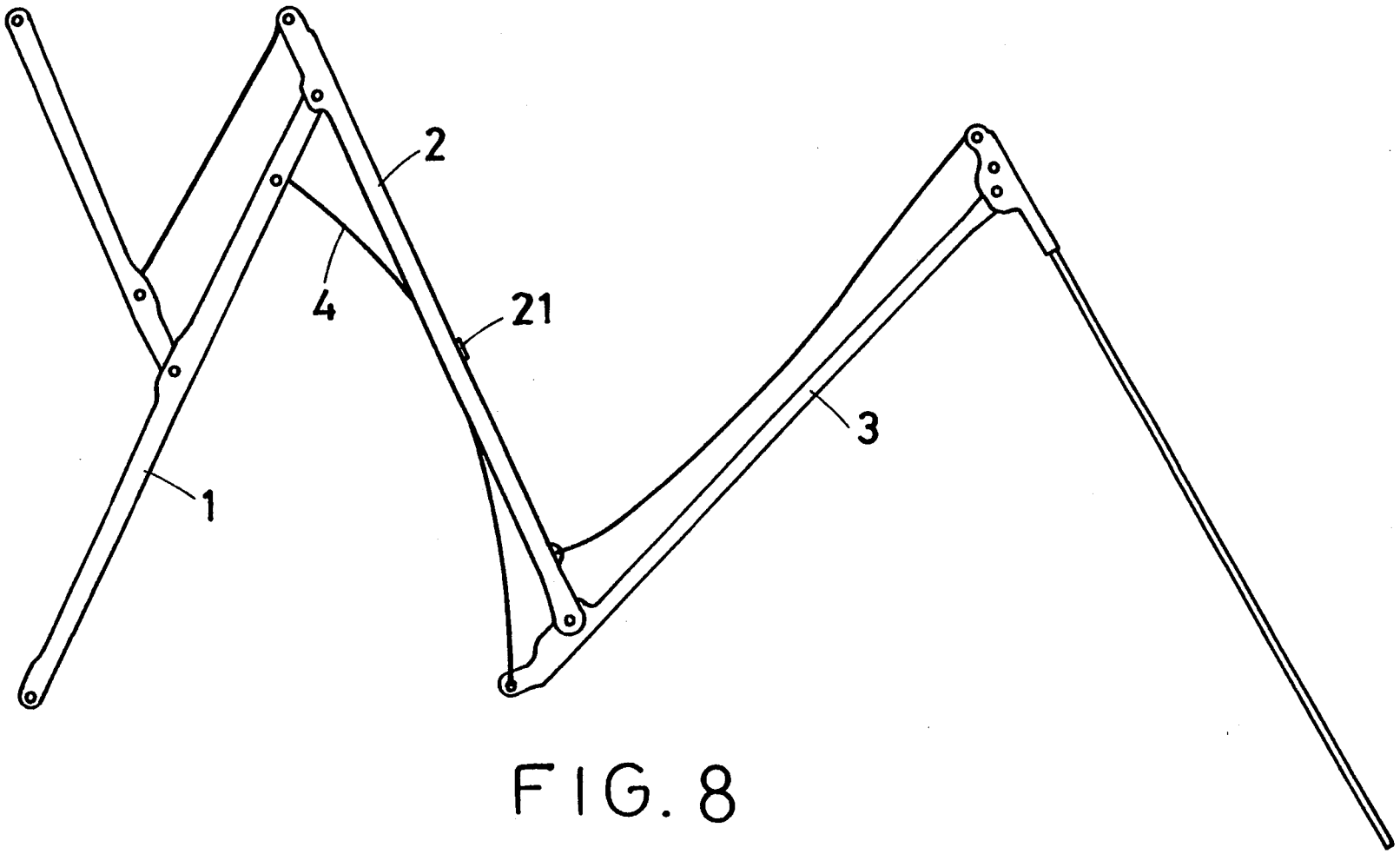
FIG. 8 is an orthographic drawing of another embodiment of the invention herein.
Figure 9:
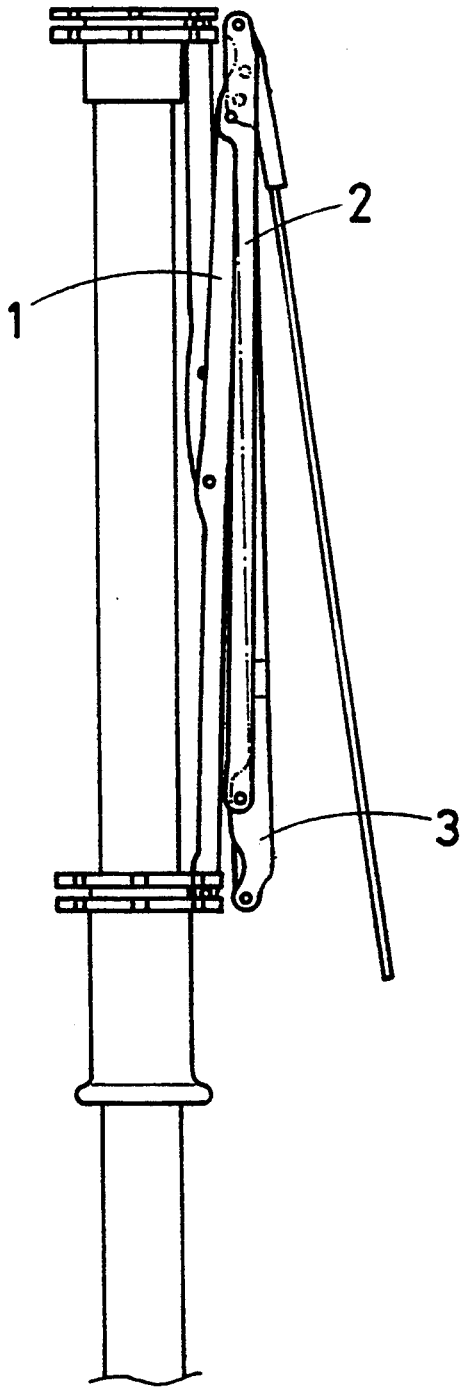
FIG. 9 is an orthographic drawing of the invention herein when folded.

As indicated in FIG. 3, FIG. 4 and FIG. 5, the invention herein mainly modifies the entire umbrella strut spreader structure, wherein the first main strut member (1) extends downward to a position near the inner side of the center pole facing the U-shaped opening, thereby avoiding the shortcomings of the conventional structure and providing assured safety. One end of the leaf-type strut member (4) of the invention herein is hooked onto the first main strut member (1) (as indicated in view 3-A of FIG. 3) and the other end is hinged to inner side of the third main strut member (3), and (as indicated in view 3-B of FIG. 3) the center section is inserted through the round hole (22) in the T-shaped guide (21) positioned at the center of the second main strut member (2) and is confined to the limited space of the round hole (22); the distance between the leaf-type strut member (4) and the second main strut member (2) is relatively short due to the spacing of the base section (23) of the T-shaped guide (21), such that when the umbrella is opened and folded, the force of the opening and folding is directly transferred as indicated in FIG. 6 and FIG. 7, resulting in a smooth transition at movement points of the umbrella strut spreaders and improving the difficulty of the conventional structure. As indicated in FIG. 8, the manner of connecting the two ends of the leaf-type strut member (4) allows for relative adjustment in that the inner end is hinged to the first main strut member (1) and the outer end is hooked at the inner end of the third main strut member (3).

Figure 10:
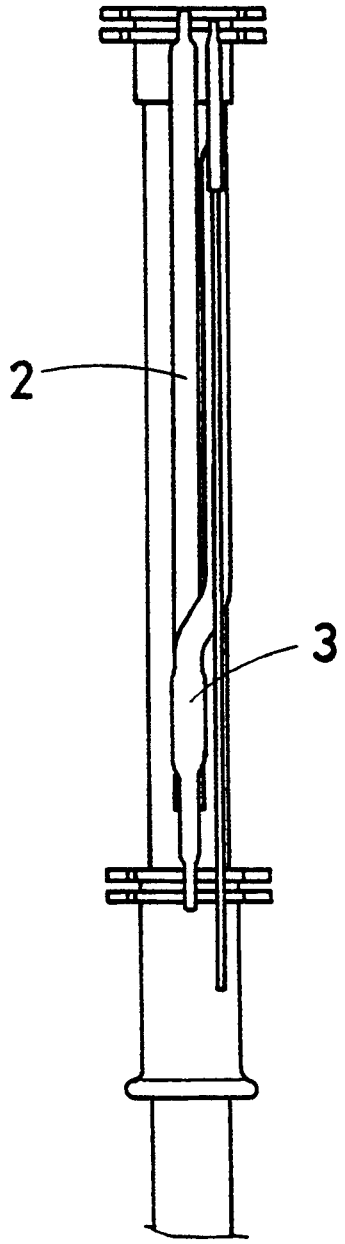
FIG. 10 is an orthographic drawing of the invention herein when folded as viewed from another angle.
Figure 11:
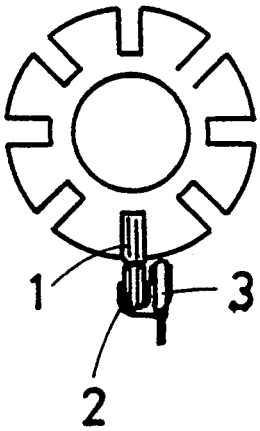
FIG. 11 is an orthographic drawing of the invention herein as viewed from an upper perspective.
Figure 12:
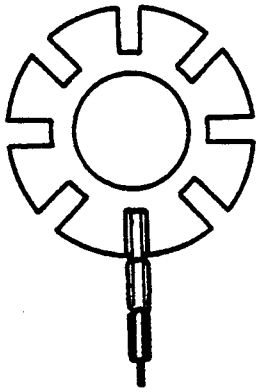
FIG. 12 PRIOR ART
FIG. 12 is an orthographic drawing of a conventional umbrella strut spreader from an upper perspective as compared with FIG. 11.

As indicated in FIG. 4, FIG. 9, FIG. 10 and FIG. 11, the third main strut member (3) can be designed as an contiguous S-shaped umbrella strut spreader element and, therefore, when the umbrella strut spreaders are folded, the upper half of the third main strut member (3) is drawn near to the side of the second main strut member (2) and, as clearly illustrated by FIG. 10 and FIG. 11, the ends of the umbrella strut spreaders become even smaller following the folding of the umbrella; as indicated in FIG. 12, the ends of a conventional umbrella strut spreader assume the overall physical thickness of two hinges compared to the physical thickness of a single hinge and as such will occupy a larger physical area when all the umbrella strut spreaders are considered; therefore, the physical dimensions of the rear ends of the invention herein are the thickness of a single hinge and, furthermore, the physical dimensions of the front ends are also the thickness of a single hinge such that the overall physical dimensions are substantially smaller; therefore, the invention herein effectively reduces the dimensions of a folded umbrella, the results of which can manifested in reality.

What is claimed is:

1. A four-section umbrella strut spreader structure comprising:

(a) a first main strut member having a U-shaped cross-sectional contour defining an upwardly directed opened section and an end section;

(b) a second main strut member having a U-shaped cross-sectional contour pivotally connected to said end section of said first main strut member, at a first end section of said second main strut member;

(c) a third main strut member having a U-shaped cross-sectional contour pivotally connected to said second main strut member at a second end section of said second main strut member;

(d) a T-shaped guide bolt secured to a base leg of said U-shaped cross-sectionally contoured second main strut member at a central section thereof, said T-shaped guide bolt having a head member and a bolt leg extending therefrom, said bolt leg having a horizontally guide opening formed therethrough; and, (e) a leaf spring strut member extending through said guide opening and pivotally coupled on opposing ends thereof to said end section of said first main strut member and said third main strut member, whereby said T-shaped guide bolt maintains said leaf spring strut member substantially contiguous to said second main strut member at said central section.

2. The four-section umbrella strut spreader structure as recited in claim 1 where said third main strut member includes an elongated S-shaped contour whereby when said third main strut member is pivotally displaced into adjacent positional relation with respect to said second main strut member a reduced volume dimension is attained for said four-section umbrella strut spreader structure.

* * * * *